US009255466B2

(12) United States Patent
Javed

(10) Patent No.: US 9,255,466 B2
(45) Date of Patent: Feb. 9, 2016

(54) LINER HANGER FLUID DIVERTER TOOL AND RELATED METHODS

(75) Inventor: Asif Javed, Dubai (UA)

(73) Assignee: Smith International, Inc., Houston, TX (US)

( * ) Notice: Subject to any disclaimer, the term of this patent is extended or adjusted under 35 U.S.C. 154(b) by 837 days.

(21) Appl. No.: 13/117,720

(22) Filed: May 27, 2011

(65) Prior Publication Data

US 2012/0018172 A1 Jan. 26, 2012

Related U.S. Application Data

(60) Provisional application No. 61/350,328, filed on Jun. 1, 2010.

(51) Int. Cl.

| | |
|---|---|
| ***E21B 23/00*** | (2006.01) |
| ***E21B 34/00*** | (2006.01) |
| ***E21B 43/10*** | (2006.01) |
| ***E21B 34/14*** | (2006.01) |

(52) U.S. Cl.

CPC ..... *E21B 43/10* (2013.01); *E21B 34/14* (2013.01); *E21B 2034/002* (2013.01)

(58) Field of Classification Search

CPC ... E21B 23/01; E21B 23/00; E21B 2034/002; E21B 34/10; E21B 34/06; E21B 34/102; E21B 34/00

USPC ..... 166/373, 374, 381, 382, 330, 332.3, 166/332.7, 334.2, 334.4; 137/519.5; 251/304

See application file for complete search history.

(56) References Cited

U.S. PATENT DOCUMENTS

| | | | | | |
|---|---|---|---|---|---|
| RE29,471 | E | * | 11/1977 | Giroux | 166/334.2 |
| 4,074,761 | A | * | 2/1978 | Mott | 166/373 |
| 4,230,185 | A | | 10/1980 | Fredd | |
| 4,253,524 | A | | 3/1981 | Erickson | |
| 4,291,722 | A | * | 9/1981 | Churchman | 137/496 |
| 4,341,266 | A | | 7/1982 | Craig | |
| 4,420,045 | A | * | 12/1983 | McMahan | 166/334.2 |
| 4,441,558 | A | | 4/1984 | Welch et al. | |
| 4,470,464 | A | | 9/1984 | Baldenko et al. | |
| 4,505,341 | A | | 3/1985 | Moody et al. | |
| 4,582,140 | A | * | 4/1986 | Barrington | 166/334.2 |
| 4,688,593 | A | | 8/1987 | Pringle et al. | |
| 4,697,638 | A | | 10/1987 | Knight | |
| 4,711,305 | A | * | 12/1987 | Ringgenberg | 166/336 |
| 4,856,595 | A | | 8/1989 | Upchurch | |

(Continued)

OTHER PUBLICATIONS

Baker Hughes. Hyflo Surge Protection System. Liner setting tools. pp. 1-2. 2010 Baker Hughes Incorporated 27226.

(Continued)

*Primary Examiner* — Blake Michener
*Assistant Examiner* — Michael Wills, III
(74) *Attorney, Agent, or Firm* — Michael Stonebrook

(57) ABSTRACT

A downhole fluid diverter tool includes a tool body having a central bore therethrough and a bypass port formed in an outer diameter thereof, a spring-biased piston disposed within the tool body, a piston port in the spring-biased piston configured to axially align with the bypass port to control fluid flow outward from the central bore, and a rotatable ball valve aligned within the central bore of the tool body and configured to control fluid flow through the central bore, wherein the bypass port and the ball valve are configured to be cycled multiple times between open and closed positions while in a wellbore.

13 Claims, 7 Drawing Sheets

(56) References Cited

U.S. PATENT DOCUMENTS

| | | | | |
|---|---|---|---|---|
| 5,058,674 | A | 10/1991 | Schultz et al. | |
| 5,228,516 | A * | 7/1993 | Barrington | 166/334.2 |
| 5,240,072 | A | 8/1993 | Schultz et al. | |
| 5,529,126 | A * | 6/1996 | Edwards | 166/331 |
| 5,865,251 | A | 2/1999 | Rebardi et al. | |
| 5,890,540 | A * | 4/1999 | Pia et al. | 166/321 |
| 5,984,014 | A * | 11/1999 | Poullard et al. | 166/374 |
| 6,065,355 | A | 5/2000 | Schultz | |
| 6,148,919 | A * | 11/2000 | Burris et al. | 166/319 |
| 6,167,970 | B1 | 1/2001 | Stout et al. | |
| 6,244,351 | B1 | 6/2001 | Patel et al. | |
| 6,354,378 | B1 | 3/2002 | Patel | |
| 7,066,265 | B2 | 6/2006 | Surjaatmadja | |
| 7,185,704 | B2 | 3/2007 | Bigelow et al. | |
| 7,318,478 | B2 * | 1/2008 | Royer | 166/332.4 |
| 2001/0045285 | A1 * | 11/2001 | Russell | 166/332.3 |
| 2003/0089505 | A1 | 5/2003 | Pluchek et al. | |
| 2003/0136563 | A1 * | 7/2003 | Allamon et al. | 166/386 |
| 2004/0000406 | A1 | 1/2004 | Allamon et al. | |
| 2009/0056952 | A1 | 3/2009 | Churchill | |
| 2009/0139726 | A1 | 6/2009 | Gomez | |
| 2009/0250224 | A1 * | 10/2009 | Wright et al. | 166/373 |

OTHER PUBLICATIONS

Weatherford. SurgeMaster II Multiple-Opening Diverter Tool. pp. 1-4. 2005-2008 Weatherford International Ltd. 1337.03.

* cited by examiner

LINER HANGER FLUID DIVERTER TOOL AND RELATED METHODS

CROSS-REFERENCE TO RELATED APPLICATIONS

This application claims the benefit of U.S. Provisional Application No. 61/350,328 filed Jun. 1, 2010, incorporated herein by reference.

BACKGROUND

1. Field of the Disclosure

Embodiments disclosed herein relate generally to downhole tools, particularly liners and other hydraulically actuated devices. More specifically, embodiments disclosed herein relate to liner hanger flow diverter apparatuses and methods used when running liners.

2. Background Art

Typically, liners are used below casing in wellbores to extend the length of the casing. A liner is a section of smaller casing that is suspended downhole in existing casing. In most cases, the liner extends downwardly into an open hole and overlaps the existing casing by approximately 200-400 ft. In certain application, the liner may be cemented in place. A conventional liner hanger is used to attach or hang liners from the internal wall of a casing segment. The liner hanger is typically connected to a running tool, which in turn is connected to a string of drill pipe extending to the surface. This entire assembly may be run to a bottom of the well, after which the liner is cemented in place.

When running tighter clearance liners down the well, there may not be sufficient space in the annulus between the liner and open hole for the drilling fluid to flow up through the annulus and out of the wellbore. Restricted flow through the annulus may create a positive pressure ahead (or downhole) of the liner called "surge pressure," which may crack the wellbore formation, causing a variety of problems.

To avoid the surge pressure buildup in the well, a fluid diverter tool may be connected above a liner hanger running tool, which may provide an alternative fluid flow path (e.g., with flow ports) for the escaping fluid by allowing the fluid to flow up a central bore of the fluid diverter tool, past the tighter clearance annulus, and then out into the annulus above the liner. In this manner, the escaping fluid is not forced to flow only through the restrictive annulus formed between the tight clearance liner and the well. By running a fluid flow diverter tool, surge pressure generated may be reduced or eliminated/prevented in the well. When the liner is run to the desired depth in the well, the flow ports in the fluid diverter tool may be permanently closed before cementing operations commence (usually with a dropped ball).

However, there are times when the ports in the fluid diverter tool may need to be closed prior to reaching the desired depth with the liner. For example, at times during running tight liners in the well, there may be an obstruction that hinders the further lowering/running of the liner (e.g., debris, cement plugs, dried mud cake, etc). In such circumstances, drilling fluid may be pumped down the central bore to the bottom of the liner to remove the obstruction. Before pumping down the central bore, the flow ports, which have allowed escaping fluid to flow from inside to outside, must be closed. As before, with current fluid diverter tools, a ball is dropped to build pressure in the bore and shear a pin to close the ports. However, once the ball is dropped and the ports are closed, they cannot be reopened, i.e., this is a one time only operation.

Thus, further running of the liner in the wellbore to the desired depth will once again produce surge pressures because the flow diverter ports are closed.

Moreover, the manner in which ball drop mechanisms function may create a surge pressure problem. For example, in certain systems, a ball seat is attached to a piston, which is held in position by shear screws. Once the tool is activated to close the flow ports, the dropped ball remains in place. Pressure is further increased on the upstream side of the ball to the next higher value until a point where the ball extrudes through the ball seat and is blown further downhole. This sudden opening of the central bore of the fluid diverter tool causes the pressure in the central bore to travel downhole and "hit" the formation, essentially creating the same surge pressure problem discussed above.

Accordingly, there exists a need for a fluid diverter tool in which a bypass port may be repeatedly cycled between open and closed positions while in the wellbore as needed.

SUMMARY OF THE DISCLOSURE

In one aspect, embodiments disclosed herein relate to a downhole fluid diverter tool including a tool body having a central bore therethrough and a bypass port formed in an outer diameter thereof, a spring-biased piston disposed within the tool body, a piston port in the spring-biased piston configured to axially align with the bypass port to control fluid flow outward from the central bore, and a rotatable ball valve aligned within the central bore of the tool body and configured to control fluid flow through the central bore, wherein the bypass port and the ball valve are configured to be cycled multiple times between open and closed positions while in a wellbore.

In other aspects, embodiments disclosed herein relate to a method for installing liners in a wellbore having a fluid diverter tool attached thereto, the method including running the fluid diverter tool and liner into the wellbore, wherein the fluid diverter tool provides a fluid crossover from a central bore to an outer diameter of the fluid diverter tool with a bypass port, cycling a piston to open and close the bypass port and control fluid flow out from the central bore of the fluid diverter tool, and simultaneously cycling a ball valve disposed in the central bore between open and closed positions to control fluid flow through the central bore, wherein the bypass port and the ball valve are cycled between open and closed positions multiple times.

Other aspects and advantages of the invention will be apparent from the following description and the appended claims.

DETAILED DESCRIPTION

In one aspect, embodiments disclosed herein relate to a fluid diverter tool used when running tight clearance liner hangers into a wellbore. The fluid diverter tool provides an alternative fluid path, or crossover from an inner bore of the tool to an outer diameter, for escaping fluid to flow as the liner is lowered into the wellbore. Further, fluid ports of the fluid diverter tool may be opened and closed repeatedly as needed to alleviate the pressure surge associated with running tight clearance liners into wellbores. The fluid diverter tool is attached in the drillstring above a liner hanger running tool (which has the liner hanger and liner attached downhole thereto). The top of the fluid diverter tool is attached to drill pipe that extends upward to the surface.

Figure 1:
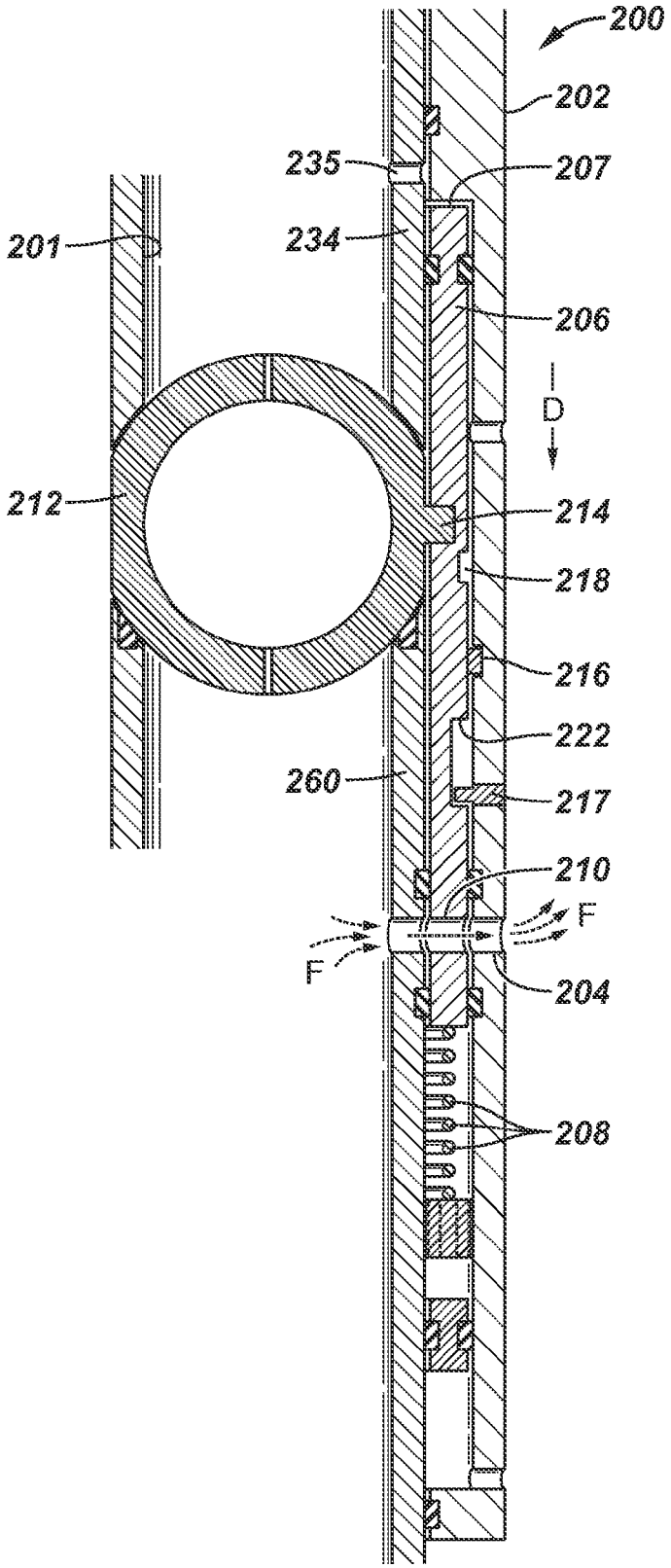
FIG. 1 shows a cross-section view of a fluid diverter tool in accordance with embodiments of the present disclosure.

Referring now to FIG. 1, a cross-section view of a fluid diverter tool 200 is shown in accordance with embodiments of the present disclosure. Fluid diverter tool 200 includes a tool body 202 having a central bore 201 therethrough. A bypass port 204 is formed through a wall of the tool body 202 and is configured to align with a piston port 210 formed in a piston 206 disposed within the tool body 202. The bypass port 204 and the piston port 210 are biased into an axial alignment by a spring 208, which is coupled to a lower end of piston 206. When the bypass port 204 and the piston port 210 are in axial alignment, fluid "F" is allowed to flow from the central bore 201 out of the fluid diverter tool 200.

Further, a rotatable ball valve 212 is disposed and aligned within central bore 201 between fixed lower and upper sleeves 260, 234, respectively. Those skilled in the art will appreciate that any type of quarter turn valve may be used in place of the ball valve. The rotatable ball valve 212 is coupled to the piston 206 by a pin 214. The rotatable ball valve 212 is configured to control fluid flow that is pumped downward through central bore 201. In certain embodiments, rotatable ball valve 212 may be operated using a camming device. Referring now to FIGS. 2-5, perspective views of rotatable ball valve 212 and a corresponding camming device 220 of fluid diverter tool 200 in accordance with embodiments of the present disclosure are shown. The tool body 202 is removed and the piston 206 (both shown in FIG. 1) is shown in dashed lines to more easily see the operation of the camming device 220.

Figure 2:
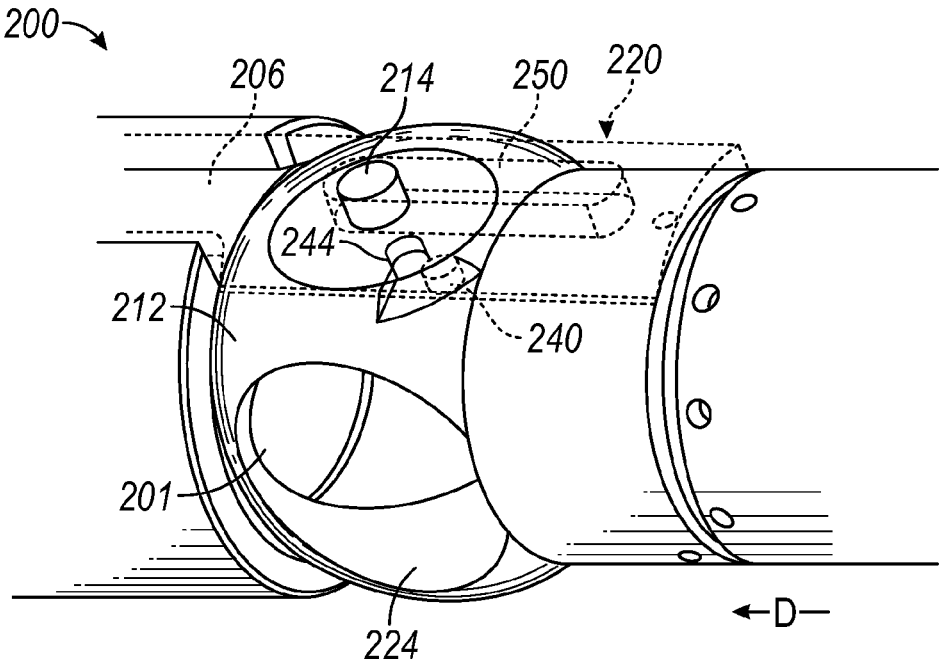
FIGS. 2 and 3 show perspective views of a camming device and rotatable ball valve of a fluid diverter tool in a closed position in accordance with embodiments of the present disclosure.
Figure 3:
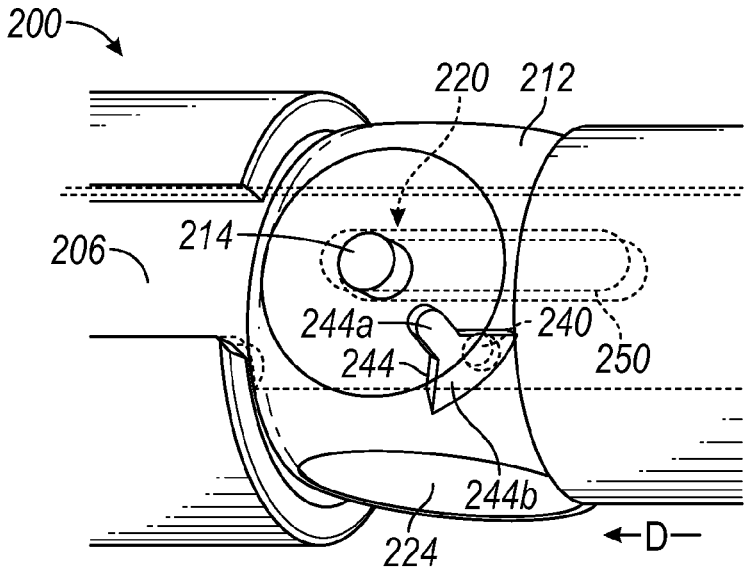
Figure 4:
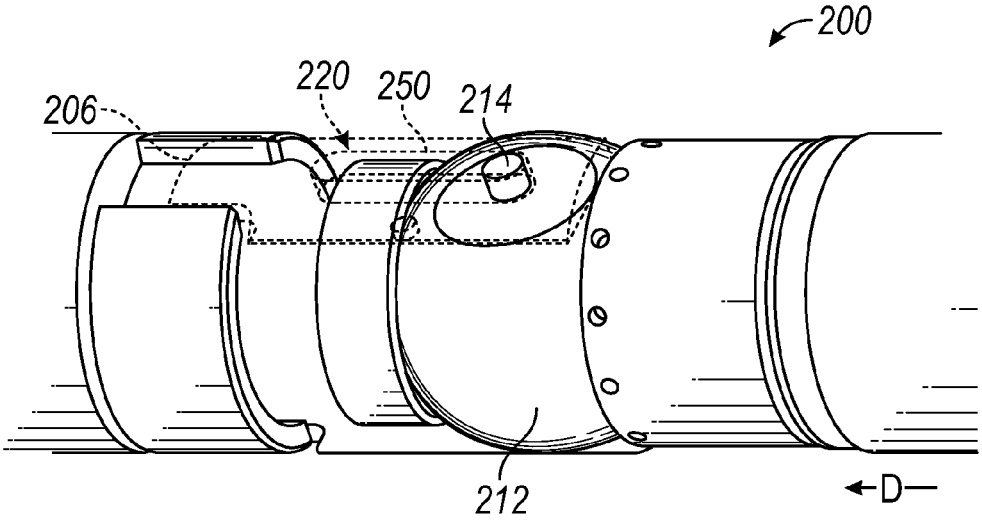
FIGS. 4 and 5 show perspective views of a camming device and rotatable ball valve of a fluid diverter tool in an open position in accordance with embodiments of the present disclosure.
Figure 5:
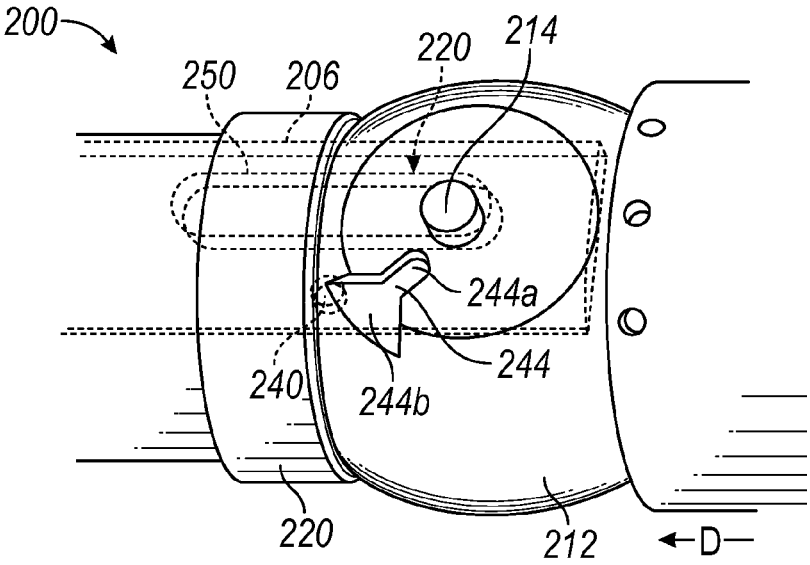

Referring initially to FIGS. 2 and 3, rotatable ball valve 212 is shown in a first position (i.e., closed position) in accordance with the second embodiment of the present disclosure. In the first position, the rotatable ball valve 212 is oriented in the central bore 201 (FIG. 1) such that fluid flow through the fluid diverter tool 200 is restricted or prevented (i.e., a bore 224 of rotatable ball valve 212 is oriented perpendicular to central bore 201 (FIG. 1) of the fluid diverter tool 200. Rotatable ball valve 212 may be rotated within downhole tool 200 from the first position to a second position (i.e., open position) by a camming device 220. In the second position, rotatable ball valve bore 224 is aligned with the central bore 201, such that full-bore fluid flow is allowed through the fluid diverter tool 200.

The camming device 220 may include a plurality of inwardly facing camming pins 240 disposed on an inner surface of the piston 206. The camming device 220 may also include a plurality of corresponding cam slots 244 disposed in an outer surface of the rotatable ball valve 212, which are configured to slidably engage with the plurality of camming pins 240. In alternate embodiments, cam slots 244 may be disposed on an inner surface of the piston 206 with camming pins disposed on the outer surface of the ball valve 212 (not shown). The camming pins 240 and corresponding cam slots 244 are off-centered from a rotational axis (provided by pin 214) of the ball valve 212 to allow engagement of the camming pins 240 with the cam slots 244 to provide a torque to rotate the ball valve 212. Cam slot 244 may include cam slot channel 244*a* and cam slot mouth 244*b*. One of ordinary skill will appreciate that both a single cam slot/camming pin and/or a plurality of cam slots/camming pins may be used with embodiments disclosed herein.

As previously described, pins 214, which are located on an outer surface of the rotatable ball valve 212, provide a rotation axis about which the rotatable ball valve 212 rotates. Pins 214 are held in place by a pair of grooves 250 formed in the piston 206, and as the piston 206 moves, the pins 214 may travel within the grooves 250 in an axial direction. When opening the rotatable ball valve 212, pins 214 may be maintained within the grooves 250 as the piston 206 is moved axially (indicated by directional arrow D). The rotatable ball valve 212 may further include a mechanical stop (not shown) to prevent the rotatable ball valve 212 from over-rotating during actuation.

Still referring to FIGS. 2-5, when the fluid diverter tool 200 is lowered into the wellbore (not shown), the rotatable ball valve 212 is oriented in the first or closed position (FIGS. 2 and 3), and thus fluid is prevented from flowing through the central bore 201 (FIG. 1) and past the rotatable ball valve 212. The rotatable ball valve 212 may be rotated and opened by increasing the fluid pressure above the rotatable ball valve 212. The increased pressure created by the restricted fluid flow above the rotatable ball valve 212 creates a force on the piston 206, which moves the piston 206 down (indicated at D). Rotatable ball valve 212 rotates to an open position due to engagement of the camming device 220, as discussed in more detail below.

Camming device 220 forces the rotatable ball valve 212 to rotate from the closed position to the open position around an axis of rotation provided by pins 214, which are positioned perpendicular to central bore 201 of the fluid diverter tool 200. When corresponding camming slots 244 of the rotatable ball valve 212 engage camming pins 240, a torque is imparted to the rotatable ball valve 212 that causes it to rotate 90 degrees from closed to open. Pins 214 travel within grooves 250 of the piston 206 as the piston 206 moves downward and the ball valve 212 rotates.

Referring back to FIG. 1, the fluid diverter tool 200 may be run into the wellbore with the bypass port 204 open (i.e., bypass port 204 axially aligned with the piston port 210) and the rotatable ball valve 212 closed, as shown. As the fluid diverter tool 200 is run into the wellbore, escaping fluid "F" may travel up through central bore 201 and out bypass port 204. In certain instances, drilling fluid may need to be pumped down the central bore 201 (e.g., to remove obstructions in the wellbore). To do so, the bypass port 204 needs to be closed and the rotatable ball valve 212 opened.

Fluid is pumped downward through central bore 201 and fluid pressure in the central bore 201 is increased upstream of the rotatable ball valve 212 because rotatable ball valve 212 is closed. Pressure increases above the ball valve 212 as the fluid flows against surfaces of the closed ball valve 212, as well as flowing through a port 235 and pushing downward on an upper face 207 of piston 206. The increased pressure upstream of the rotatable ball valve 212 applied on the piston face 207 causes the piston 206 to move downward against the spring 208 (i.e., the fluid pressure against the piston 206 overcomes the upward force exerted by the spring 208). In certain embodiments, the spring force may be rated between about 600 and 800 pounds of force. Initial downward movement of the piston 206 closes the bypass port 204 by moving the piston port 210 out of alignment with the bypass port 204. Further downward movement of the piston 206 causes the camming device (FIGS. 2-5) to engage to rotate the ball valve 212 to an open position. Rotation of the ball valve 212 to an open position provides a full bore inner diameter through the ball valve, allowing the drilling fluid to be circulated down to the casing. Once the ball valve 212 is open, fluid pressure is maintained against piston face 207 to press the piston 206 downward on the spring 208, which keeps the ball valve 212 open and the bypass port 204 closed. In addition, the fluid flow through the bore 224 (FIGS. 2-5) of the ball valve 212 maintains the ball valve 212 in the open position.

To close the rotatable ball valve 212 and reopen the bypass port 204, circulation of drilling fluid down through the central bore 201 is stopped, which allows the spring 208 to force the piston 206 upward, closing the ball valve 212 and reopening the bypass port 204 by axially realigning the bypass port 204 with the piston port 210 in a manner opposite of the opening procedure described above. After the rotatable ball valve 212 is closed and the bypass port 204 reopened, liner can continue to be run further down into the wellbore, while allowing fluid to travel up the central bore 201 and out the bypass port 204 to alleviate pressure surges. This method (i.e., cyclical opening and closing of the bypass port and ball valve) may be repeated as many times as necessary while running the liner until the desired wellbore depth is reached.

When the liner is run to the desired wellbore depth, it may be desirable to permanently open the rotatable ball valve and close the bypass port 204 to allow additional tools or fluid to pass down through the central bore 201, or to allow cementing operations to commence. Fluid pressure upstream of the rotatable ball valve 212 may be increased to a pressure capable of shearing a shear pin 217 disposed in the tool body 202 and extending radially inward toward an outer surface of the piston 206. In certain embodiments, the increased pressure to shear pin 217 may be within a range of between about 1000 and 1600 psi. In other embodiments, the increased pressure may be up to about 2000 psi. In any event, the shear pin 217 is selected such that a pressure required to shear the pin is greater than the pressure require to move the piston 206 (when cycling the ball valve and bypass ports between open/closed positions). The piston 206 is moved downward to shear the shear pin 217 and close the bypass port 204, thereby allowing rotation of the ball valve 212. Specifically, a shoulder 222 of the piston 206 moves downward into contact with the shear pin 217 and shears the pin. A snap ring 216 engages a groove 218 in the piston 206, thereby acting as a locking device to keep the rotatable ball valve 212 permanently open and the bypass port 204 permanently closed. Thus, further cyclic action of the fluid diverter tool 200 may be prevented.

Figure 6:
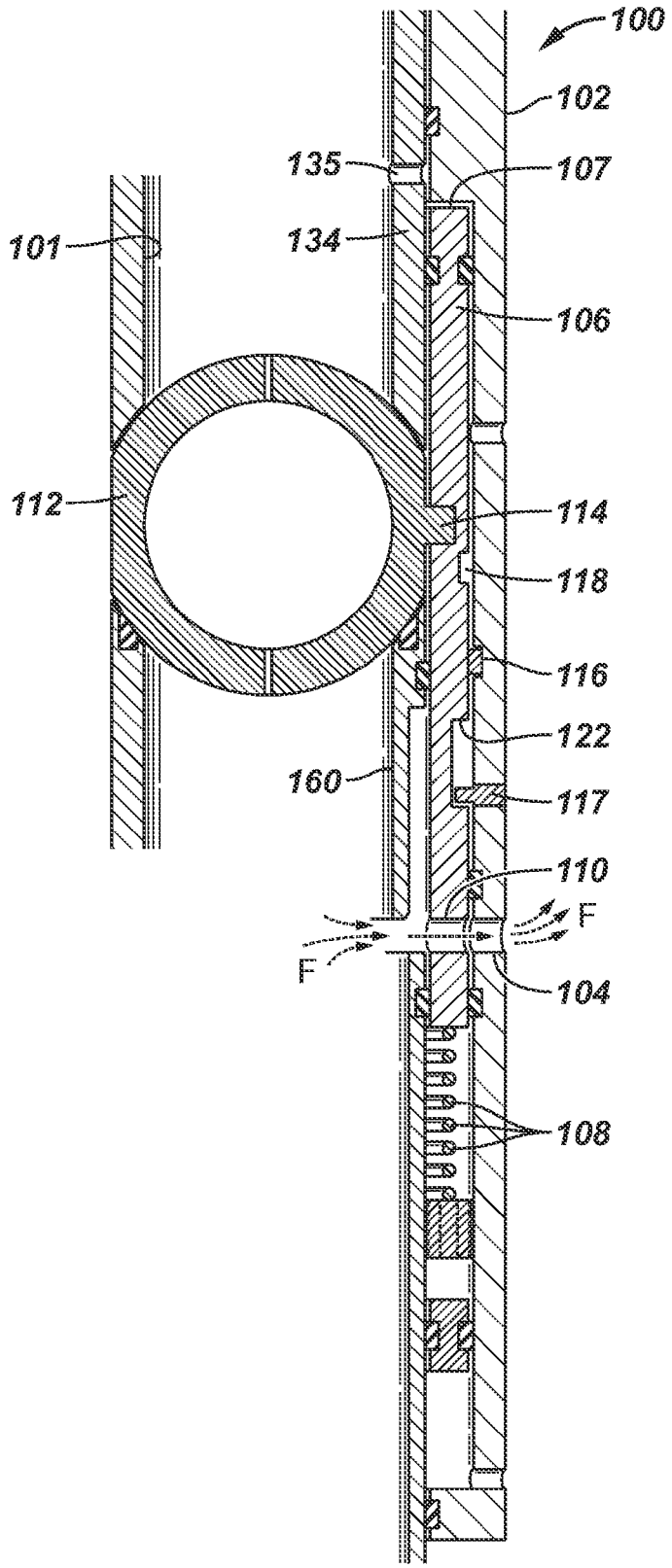
FIG. 6 shows a cross-section view of a fluid diverter tool in accordance with alternate embodiments of the present disclosure.

Referring now to FIG. 6, a cross-section view of a fluid diverter tool 100 is shown in accordance with alternate embodiments of the present disclosure. Fluid diverter tool 100 includes a tool body 102 having a central bore 101 therethrough. A bypass port 104 is formed through a wall of the tool body 102 and is configured to align with a piston port 110 formed in a piston 106 disposed within the tool body 102. The bypass port 104 and the piston port 110 are biased into an axial alignment by a spring 108, which is coupled to a lower end of piston 106. When the bypass port 104 and the piston port 110 are in axial alignment, fluid "F" is allowed to flow from the central bore 101 out of the fluid diverter tool 100.

Further, a rotatable ball valve 112 is disposed and aligned within central bore 101 between a lower sliding sleeve 160 and an upper stationary sleeve 134 (shown in dashed lines for a better view of the underlying components). Those skilled in the art will appreciate that any type of quarter turn valve may be used in place of the ball valve. The rotatable ball valve 112 is coupled to the piston 106 by a pin 114. The rotatable ball valve 112 is configured to control fluid flow that is pumped downward through central bore 101. In certain embodiments, rotatable ball valve 112 may be operated using a camming device. Referring now to FIGS. 7-10, perspective views of rotatable ball valve 112 and a corresponding camming device 120 of fluid diverter tool 100 in accordance with embodiments of the present disclosure are shown. The tool body 102 and piston 106 (both shown in FIG. 6) are removed to more easily see the operation of the camming device 120.

Figure 7:
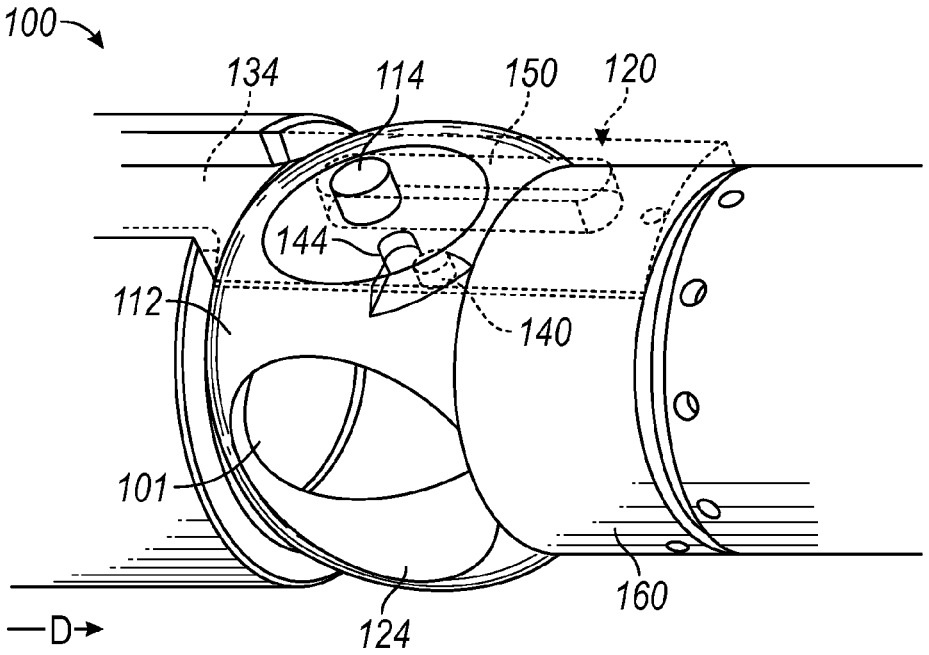
FIGS. 7 and 8 show perspective views of a camming device and rotatable ball valve of a fluid diverter tool in a closed position in accordance with alternate embodiments of the present disclosure.
Figure 8:
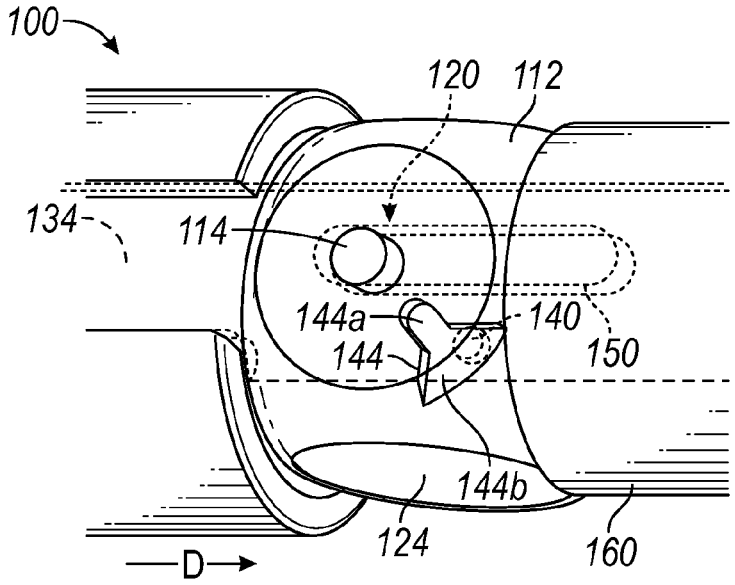

Referring initially to FIGS. 7 and 8, rotatable ball valve 112 is shown in a first position (i.e., closed position). In the first position, the rotatable ball valve 112 is oriented in the central bore 101 (FIG. 6) such that fluid flow through the fluid diverter tool 100 is restricted or prevented (i.e., a bore 124 of rotatable ball valve 112 is oriented perpendicular to central bore 101 (FIG. 6) of the fluid diverter tool 100. Rotatable ball valve 112 may be rotated within downhole tool 100 from the first position to a second position (i.e., open position) by a camming device 120. In the second position, rotatable ball valve bore 124 is aligned with the central bore 101, such that full-bore fluid flow is allowed through the fluid diverter tool 100.

Fluid diverter tool 100 may also include a sliding sleeve assembly 160 located below the rotatable ball valve 112 and a stationary sleeve 134 located above the rotatable ball valve 112. The camming device 120 may include a plurality of inwardly facing camming pins 140 disposed on an inner surface of the stationary sleeve 134. The camming device 120 may also include a plurality of corresponding cam slots 144 disposed in an outer surface of the rotatable ball valve 112, which are configured to slidably engage with the plurality of camming pins 140. The camming pins 140 and corresponding cam slots 144 are off-centered from a rotational axis (provided by pins 114) of the ball valve 112 to allow engagement of the camming pins 140 with the cam slots 144 to provide a torque to rotate the ball valve 112. Cam slot 144 may include cam slot channel 144*a* and cam slot mouth 244*b*.

Further, the rotatable ball valve 112 includes two outwardly facing pins 114 oppositely located on an outer surface of the rotatable ball valve 112 and about which the rotatable ball valve 112 rotates. The pins 114 are held in place by a pair of grooves 150 formed in the stationary sleeve 134, and within which the pins 114 may travel in an axial direction. When opening the rotatable ball valve 112, the pins 114 may be maintained within the grooves 150, such that the rotatable ball valve 112 may translate axially downward (indicated by directional arrow D). The rotatable ball valve 112 may further include a mechanical stop (not shown) to prevent the rotatable ball valve 112 from over-rotating during actuation. Alternatively, a length of the grooves 150 may be configured such that full travel of the pins 114 within the groove 150 results in a fully opened ball valve 112.

Figure 9:
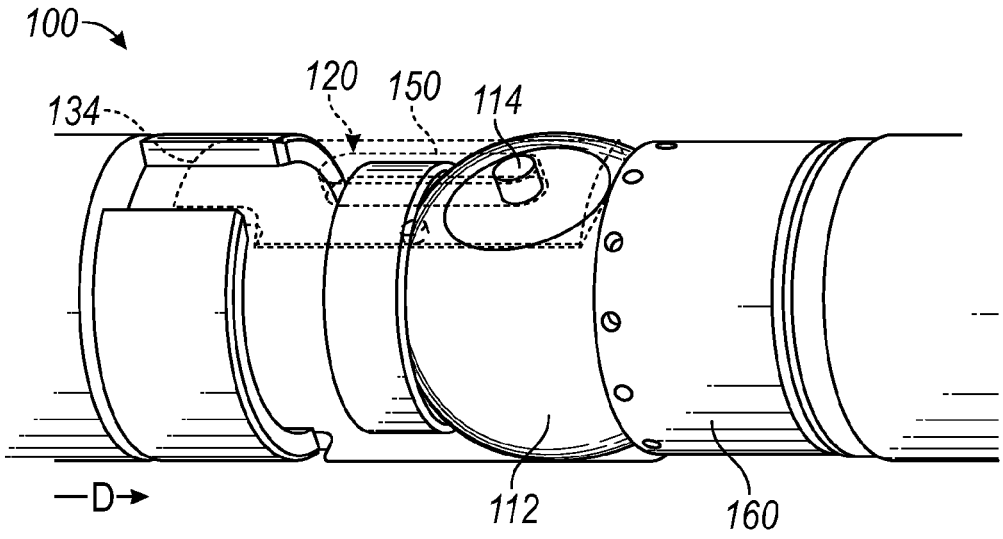
FIGS. 9 and 10 show perspective views of a camming device and rotatable ball valve of a fluid diverter tool in an open position in accordance with alternate embodiments of the present disclosure.
Figure 10:
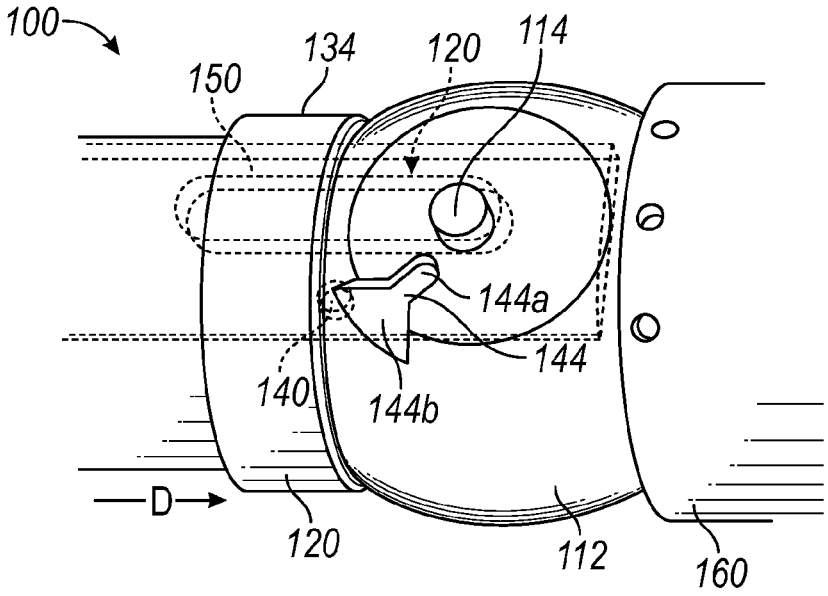

Still referring to FIGS. 7-10, when the fluid diverter tool 100 is lowered into the wellbore (not shown), the rotatable ball valve 112 is oriented in the first or closed position (FIGS. 7 and 8), and thus fluid is prevented from flowing through the central bore 101 (FIG. 6) and past the rotatable ball valve 112. The rotatable ball valve 112 may be rotated and opened by increasing the fluid pressure above the rotatable ball valve 112. The increased pressure created by the restricted fluid flow above the rotatable ball valve 112 creates a force on the sliding sleeve assembly 160, which causes the sliding sleeve assembly 160 to move downwardly (indicated at D). Rotatable ball valve 112 also moves downward and begins to rotate due to engagement of the camming device 120, as discussed in more detail below. As the rotatable ball valve 112 moves downwardly, it rotates from the first position (i.e., closed position) (FIGS. 7 and 8) to the second position (i.e., open position) (FIGS. 9 and 10).

Camming device 120 forces the rotatable ball valve 112 to rotate from the closed position to the open position around an axis of rotation provided by pins 114, which are positioned perpendicular to central bore 101 of the fluid diverter tool 100. When corresponding camming slots 144 of the rotatable ball valve 112 engage camming pins 140 as the rotatable ball valve 112 is moving downwardly (indicated by D), a torque is imparted to the rotatable ball valve 112 that causes it to rotate 90 degrees from closed to open. Pins 114 engaged with grooves 150 of sliding sleeve 160 guide the ball valve 112 downward as the ball valve 112 rotates.

Referring back to FIG. 6, the fluid diverter tool 100 may be run into the wellbore with the bypass port 104 open (i.e., bypass port 104 axially aligned with the piston port 110) and the rotatable ball valve 112 closed, as shown. As the fluid diverter tool 100 is run into the wellbore, escaping fluid "F" may travel up through central bore 101 and out bypass port 104. In certain instances, drilling fluid may need to be pumped down the central bore 101 (e.g., to remove obstructions in the wellbore). To do so, the bypass valve 104 needs to be closed and the rotatable ball valve 112 opened.

Fluid is pumped downward through central bore 101 and fluid pressure in the central bore 101 is increased upstream of the rotatable ball valve 112 because rotatable ball valve 112 is closed. Fluid flows through a port 135 in the upper stationary sleeve 134 and pushes downward on an upper face 107 of piston 106. The increased pressure upstream of the rotatable ball valve 112 applied on the piston face 107 causes the piston 106 to move downward against the spring 108 (i.e., the fluid pressure against the piston 106 overcomes the upward force exerted by the spring 108). Initial downward movement of the piston 106 closes the bypass port 104 by moving the piston port 110 out of alignment with the bypass port 104. Further downward movement of the piston 106 causes the lower sliding sleeve 160 and rotatable ball valve 112 to movement downward, which engages the camming device (FIGS. 7-10) described above to rotate the ball valve 112 to an open position. Rotation of the ball valve 112 to an open position provides a full bore inner diameter through the ball valve, allowing the drilling fluid to be circulated down to the casing. Once the ball valve 112 is open, fluid pressure is maintained against piston face 107 to press the piston 106 downward on the spring 108, which keeps the ball valve 112 open and the bypass port 104 closed.

To close the rotatable ball valve 112 and reopen the bypass port 104, circulation of drilling fluid down through the central bore 101 is stopped, which allows the spring 108 to force the piston upward, closing the ball valve 112 and reopening the bypass port 104 by axially realigning the bypass port 104 with the piston port 110. After the rotatable ball valve 112 is closed and the bypass port 104 reopened, liner can continue to be run further down into the wellbore, while allowing fluid to travel up the central bore 101 and out the bypass port 104 to alleviate pressure surges. This method (i.e., cyclical opening and closing of the bypass port and ball valve) may be repeated as many times as necessary while running the liner until the desired wellbore depth is reached. As before, to lock the piston 106 downward, which permanently closes bypass port 104 and opens ball valve 112), a shear pin 117 may be sheared by increasing the pressure uphole of the ball valve 112, and the piston 106 may be moved downward to allow a snap ring 116 to engage a corresponding groove 118 in piston 106.

Advantageously, embodiments of the present disclosure for the liner hanger fluid diverter tool are capable of cyclic operation for opening and closing of the bypass port as the liner is run into the wellbore. Unlike previous tools that use ball drop actuation for one-time use, embodiments of the present disclosure are capable of repeated opening and closing of the bypass port as needed. Embodiments of the present disclosure also provide a fluid crossover for escaping fluid as the liner is run into the wellbore, which prevents pressure surges from building downhole of the liner.

Figure 11:
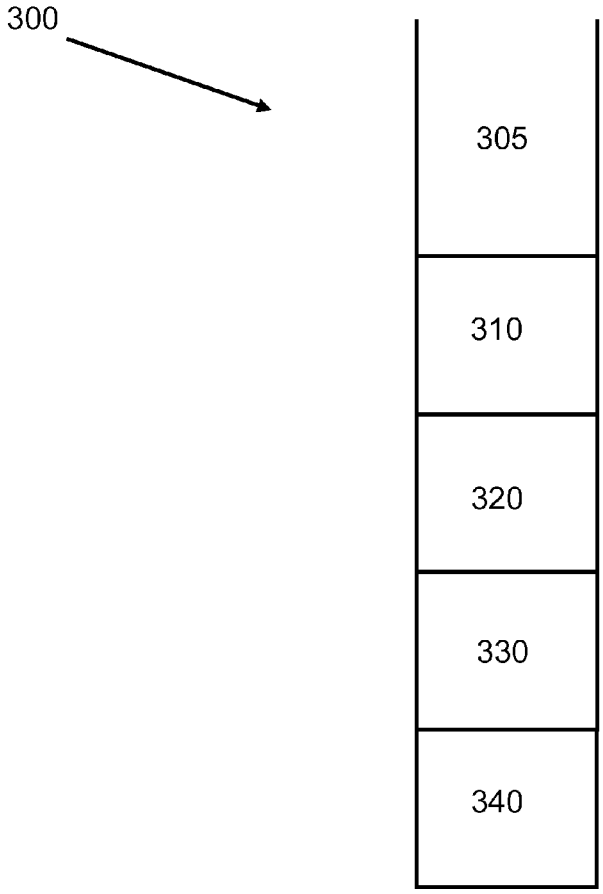
FIG. 11 shows a liner hanger fluid diverter tool assembly in accordance with an embodiment of the disclosure.

Referring generally to FIG. 11, a liner hanger fluid diverter assembly 300 in accordance with an embodiment of the disclosure is presented. The assembly 300 is affixed to the lower end of tubular 305. The assembly 300 includes a fluid diverter tool 310, a liner hanger running tool 320, a liner hanger 330, and liner 340.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A liner hanger fluid diverter tool assembly comprising:

a fluid diverter tool comprising:

a tool body having a central bore therethrough and a bypass port formed in an outer diameter thereof;

a spring-biased piston disposed within the tool body;

a piston port in the spring-biased piston configured to axially align with the bypass port to control fluid flow outward from the central bore;

a rotatable ball valve aligned within the central bore of the tool body and configured to control fluid flow through the central bore when rotated on a pin between closed and open positions within the spring-biased piston, the pin extending between the rotatable ball valve and the spring-biased piston; and wherein the bypass port and the ball valve are configured to be cycled multiple times between open and closed positions while in a wellbore;

a liner hanger running tool attached below the fluid diverter tool; and a camming device configured to rotate the rotatable ball valve between open and closed positions, the camming device comprising:

a cam slot disposed on an outer surface of the rotatable ball valve, the cam slot comprising a cam slot mouth and a cam slot channel; and a camming pin disposed on an inner surface of the piston, wherein the camming pin is guided into the cam slot channel upon axial translation of the spring-biased piston to rotate the rotatable ball valve by the cam slot mouth.

2. The tool of claim 1, wherein the camming pin and cam slot are off-centered from a rotational axis of the rotatable ball valve.

3. The tool of claim 1, further comprising a shear pin configured to fail to allow a snap ring to engage a corresponding groove in the piston to lock the bypass port in a closed position and the ball valve in an open position.

4. The tool of claim 3, wherein a pressure in the central bore of between about 1000 and 1600 psi causes the shear pin to fail.

5. The tool of claim 1, wherein the bypass port is open and the ball valve is closed as the fluid diverter tool is run into the wellbore.

6. The tool of claim 1, wherein the bypass port is closed and the ball valve is opened in the wellbore.

7. A method for installing liners in a wellbore comprising:

running an assembly comprising a fluid diverter tool, liner hanger running tool, liner hanger and liner into the wellbore, wherein the fluid diverter tool provides a fluid crossover from a central bore to an outer diameter of the fluid diverter tool with a bypass port, and wherein the liner hanger running tool is downhole of the fluid diverter tool and above the liner hanger and liner;

cycling a piston via fluid pressure inputs to open and close the bypass port and control fluid flow out from the central bore of the fluid diverter tool; and simultaneously cycling a ball valve disposed in the central bore between open and closed positions, via fluid pressure inputs, to control fluid flow through the central bore, wherein the bypass port and the ball valve are cycled between open and closed positions multiple times.

8. The method of claim 7, wherein when running the fluid diverter tool into the wellbore the bypass port is in the open position and the ball valve is closed.

9. The method of claim 8, further comprising closing the bypass port and opening the ball valve.

10. The method of claim 7, further comprising permanently closing the bypass port and opening the ball valve when the liner reaches a desired depth in the wellbore.

11. The method of claim 10, wherein the permanently closing comprises shearing at least one shear pin and engaging a snap ring with a corresponding groove in the piston.

12. The method of claim 11, further comprising increasing pressure in the central bore to between about 1000 and 1600 psi to shear the at least one shear pin.

13. The method of claim 7, further comprising providing a camming device for cycling the ball valve between the open and closed positions.

* * * * *